US005503229A

United States Patent [19]

Hill, Jr. et al.

[11] Patent Number: 5,503,229

[45] Date of Patent: Apr. 2, 1996

[54] EQUALIZING SUBSURFACE SAFETY VALVE

[75] Inventors: Thomas G. Hill, Jr., Kingwood; Scott H. Brown, Sugar Land, both of Tex.

[73] Assignee: Camco International Inc., Houston, Tex.

[21] Appl. No.: 303,489

[22] Filed: Sep. 9, 1994

[51] Int. Cl.[6] ..... E21B 34/12

[52] U.S. Cl. ..... 166/324; 166/332.7

[58] Field of Search ..... 166/319, 321, 166/324, 332.7

[56] References Cited

U.S. PATENT DOCUMENTS 4,478,286 10/1984 Fineberg ..... 166/324

4,782,895 11/1988 Jacob et al. ..... 166/324 X

*Primary Examiner*—William P. Neuder

[57] ABSTRACT

An equalizing subsurface safety valve for controlling fluid flow in a well conduit has a tubular body member with a longitudinal bore extending therethrough, and a flapper hingably connected within the tubular body member to alternately permit and prevent fluid flow through the longitudinal bore. The flapper is biased by a spring to a normally closed position to prevent fluid flow through the longitudinal bore. Surface controlled mechanisms are provided to control the opening of the flapper. A fluid passage is provided for fluid communication between the longitudinal bore adjacent a first side of the flapper when the flapper is in a closed position and a second side of the closed flapper. A valve closure member is mounted across the fluid passage adjacent the first side of the flapper and is movable along an axis generally transverse to the longitudinal bore. The valve closure member is contained so that it is prevented from possibly falling into the well. A spring contained within the fluid passage biases the valve closure member against a sealing surface formed within the tubular body. A fluid diverting passage is provided within the valve closure member to prevent an initial fluid flow through the fluid passage from contacting and eroding the sealing surface.

11 Claims, 5 Drawing Sheets

EQUALIZING SUBSURFACE SAFETY VALVE

BACKGROUND OF THE INVENTION

1. Field of the Invention

The present invention relates to a subsurface safety valve used for controlling fluid flow in a well conduit and, more particularly, to an equalizing subsurface safety valve.

2. Description of Related Art

Subsurface safety valves are commonly used in wells to prevent uncontrolled fluid flow through the well in the event of an emergency, such as to prevent a well blowout. Conventional safety valves use a flapper which is biased by a spring to a normally closed position, but is retained in an open position by the application of hydraulic fluid from the earth's surface. A typical subsurface safety valve is shown and described in U.S. Pat. No. 4,161,219, which is commonly assigned hereto.

When the flapper is in the closed position, well fluid pressure below the flapper acting upon relatively large surface area of flapper makes the opening of the flapper difficult. This difficulty in opening cannot be easily overcome simply by increasing the force exerted against the flapper because the relatively small cross-sectional area of the opening piston and cylinder assembly would require a fluid pressure that may burst the control line carrying the hydraulic fluid. To overcome the difficulty in opening the flapper, different forms of mechanisms have been developed to allow the pressure above and below the flapper to equalize prior to the complete opening of the flapper. These types of safety valves are generally referred to as "equalizing" safety valves.

Additionally, when the flapper is opened the initial flow of well fluid is relatively rapid which tends to etch or erode the primary sealing surface of the flapper. Any damage to this primary sealing surface is extremely critical because it is this sealing surface which must be in tact to prevent uncontrolled flow of well fluids and to prevent a possible well blow out.

U.S. Pat. No. 3,078,923, which is commonly assigned hereto, discloses a through-the-side wall equalizing valve mechanism which is opened by the downward movement of the flow tube prior to the flow tube contacting and opening the flapper. While the initial fluid flow is beneficially directed across the equalizing valve mechanism to keep the flapper's sealing surface undamaged, the equalizing valve mechanism is subject to the same relatively rapid fluid flow which will erode its valve sealing surface. Again, any damage to any sealing surface must be avoided for the safety valve to be fully functional in order to protect the well. Additionally, if the spring that holds the valve mechanism in place becomes damaged or lost, the valve mechanism may become off-center or simply fall out of its seat. Then, the safety valve would be non-functional because an uncontrolled opening would be created which could not prevent the well fluid from flowing therepast.

U.S. Pat. Nos. 4,427,071 and 4,457,376 each disclose an equalizing mechanism which consists of a flapper with an inclined upper surface. When the flow tube is extended to open the flapper, the lower edge of the flow tube contacts the inclined surface to cause the flapper to partially unseat the flapper prior to it being fully opened. While this equalizing mechanism does not have the spring retention problem mentioned above, it still has the problem of the initial fluid flow damaging the primary sealing surface of the flapper.

U.S. Pat. Nos. 4,415,036 and 4,478,286 each disclose an equaling mechanism which consists of a plug valve held by a spring across a vertical opening in the flapper itself. While the plug valve in U.S. Pat. No. '286 does not have the problem of the initial fluid flow eroding a sealing surface, both plug valves shown in these patents must be held by a spring that can be damaged or simply fall off due to the actions of corrosive fluids over a long period of time. Again, if the spring is lost, the plug valve will fall out of its opening in the flapper. Then, the safety valve would be non-functional because an uncontrolled opening would be created which could not prevent the well fluid from flowing therepast.

U.S. Pat. Nos. 4,629,002, 4,703,805, 4,722,399 and 5,058,682, all of which are commonly assigned hereto, each disclose equalizing mechanisms which do not address the problems of erosion of the primary sealing surface and of spring retention. Each of these patents disclose fluid flow diverting arrangements, generally referred to as labyrinth passages, to slow the initial fluid flow to prevent sealing surface erosion. In spite of these safety valves' performance benefits, these safety valves require complex machining operations and numerous parts which add significantly to their costs of manufacture.

There is a need for an equalizing safety valve which can be relatively inexpensively manufactured, and which does not suffer the problems of primary and equalizing sealing surface erosion and of spring retention.

SUMMARY OF THE INVENTION

The present invention has been contemplated to overcome the foregoing deficiencies and meet the above described needs. Specifically, the present invention is an equalizing subsurface safety valve for controlling fluid flow in a well conduit, and which is designed to prevent its equalization mechanism from being lost downhole and from being damaged by an initial flow of fluid when the flapper is opened. The safety valve of the present invention has a tubular body member having a longitudinal bore extending therethrough with a flapper hingably connected within the tubular body member to alternately permit and prevent fluid flow through the longitudinal bore. The flapper is biased by a spring to a normally closed position to prevent fluid flow through the longitudinal bore, and surface controlled mechanisms are provided to control the opening of the flapper. Fluid passage is provided for fluid communication between the longitudinal bore adjacent a first side of the flapper when the flapper is in a closed position and a second side of the closed flapper. A valve closure member is mounted across the fluid passage adjacent the first side of the flapper and movable along an axis generally transverse to the longitudinal bore in a manner so that such valve closure member cannot fall into the well. A spring contained within the fluid passage biases the valve closure member against a sealing surface formed within the tubular body. A fluid diverting passage is provided within the valve closure member to prevent an initial fluid flow through the fluid passage from contacting and eroding the sealing surface.

DETAILED DESCRIPTION OF THE PREFERRED EMBODIMENTS

For the purposes of the following discussion, it will be assumed that the present invention is installed within a subsurface safety valve of the type shown in U.S. Pat. No. 4,161,219, which are commonly referred to as rod-piston safety valves. However, it should be understood that the present invention can be used in any commercially available safety valve, be they tubing conveyed, wireline conveyed, hydraulically operated, and electrically operated.

Figure 1:
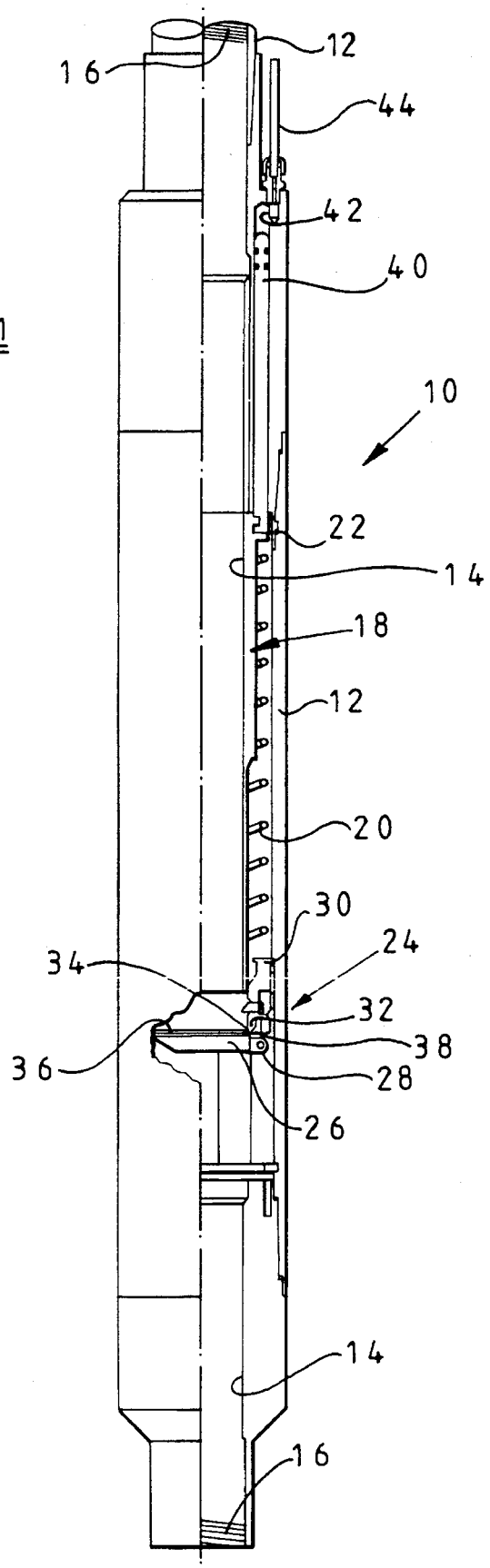
FIG. 1 is an elevational side view, partially in cross-section, showing a subsurface safety valve of the present invention.

Referring to FIG. 1, a subsurface safety valve 10 of the present invention is comprised of a generally tubular body 12 with a longitudinal bore 14 that extends therethrough. Each end of the body 12 includes mechanisms, such as threads 16, for interconnection with a pipe string (not shown) suspended within a wellbore. A sleeve member 18, usually referred to as a flow tube, is disposed within the bore 14 and is adapted for axial movement therein. The flow tube 18 includes a spring 20 disposed therearound that acts upon a shoulder 22 on the flow tube 18 to bias the flow tube 18 away from a flapper mechanism 24.

The flapper mechanism 24 generally comprises a disc or flapper valve closure member 26 with spaced arms 28 on a peripheral edge thereof that are hingably connected to an annular housing 30 mounted within the bore 18. The annular housing 30 includes a metallic annular sealing surface 32 cooperable with an annular sealing surface 34 on the flapper 26. Further, the annular housing 30 includes a secondary annular sealing surface 38 formed from an annular body of pliable material, which is cooperable with the annular sealing surface 34 on the flapper 26. The metallic sealing surface 32 is generally referred to as the "hard seat" and the pliable sealing surface 38 is generally referred to as the "soft seat".

A rod-piston system is provided to open the flapper 26, and is comprised of a piston 40 sealably mounted for reciprocal movement within a bore 42 located within the wall of the tubular body 12. A first end of the piston 40 is in contact with hydraulic fluid provided thereto from the earth's surface through a relatively small diameter control conduit 44. A second end of the piston 40 is operatively connected to the flow tube 18. When the pressure of hydraulic fluid in the control conduit 44 exceeds the force needed to compress the spring 20, the piston 40 moves to move the flow tube 18 into contact with the flapper 26 and thereby open same. In the event that the hydraulic pressure applied to the piston 40 is decreased, as by command from the earth's surface or by the control conduit 44 being damaged, the spring 20 moves the flow tube 18 away from the flapper 26. The flapper 26 then is rotated into a closed position by action of a hinge spring (not shown) to permit the annular seats 34, 36 and 38 to mate to provide a fluid seal to prevent fluid flow therepast.

As has been described above, when the flapper 26 has been closed the pressure of fluids within the bore 14 upstream of (ie. below) the closed flapper 26 increases while the pressure of the wellbore fluids downstream of (ie. above) the closed flapper 26 decreases while such wellbore fluids are recovered to the earth's surface through the pipe string. This pressure differential has made the subsequent opening of the flapper 26 difficult because the relatively small diameter control conduit 44 must provide sufficient fluid force to overcome the spring 20 as well as to move the flapper 26 against the fluid pressure therebelow to break the fluidic seal. The equalizing mechanism of the present invention permits the controlled opening of the flapper 26 in a manner that permits the fluid pressure below the flapper 26 to be reduced to thereby reduce the force necessary to open the flapper 26. More importantly, the equalizing mechanism of the present invention prevents the initial relatively high velocity flow of fluids past the flapper 26 from damaging the annular sealing surfaces 34, 36 and 38.

The equalizing mechanism of the present invention is best shown in FIGS. 2–5 wherein it is shown that the annular housing 30 includes a recess 46 and an annular bore seal 48 on an exterior surface thereof. Wellbore fluids from below the flapper 26 flow past a series of baffles or grooves 50, located on an exterior surface of the housing 30 and which are designed to slow the flow of fluids therepast, and through an opening 52 into an annular space 54 formed by the recess 46. The wellbore fluids are prevented from entering the bore 14 above the flapper 26 by action of the annular bore seal 48.

The annular housing 30 includes a generally radial bore 56 that, if unrestricted, permits fluid communication between the bore 14 above the flapper 26 and the annular space 54 and the bore 14 below the flapper 26. The bore 56 is shown as being essentially tangential to the longitudinal axis of the bore 14; however, the bore 56 can be angled in almost any direction as is desired. A tubular valve member or plug 58 is disposed for reciprocal movement within the bore 56, and includes an enlarged shoulder 60 on a first end thereof which extends into the annular space 54, and a beveled or curved portion 62 on an opposite second end thereof which extends partially into the bore 14. The enlarged shoulder 60 includes a metallic annular sealing surface 64 that cooperates with an annular sealing surface 66 on the annular housing 30 about the bore 56.

Figure 5:
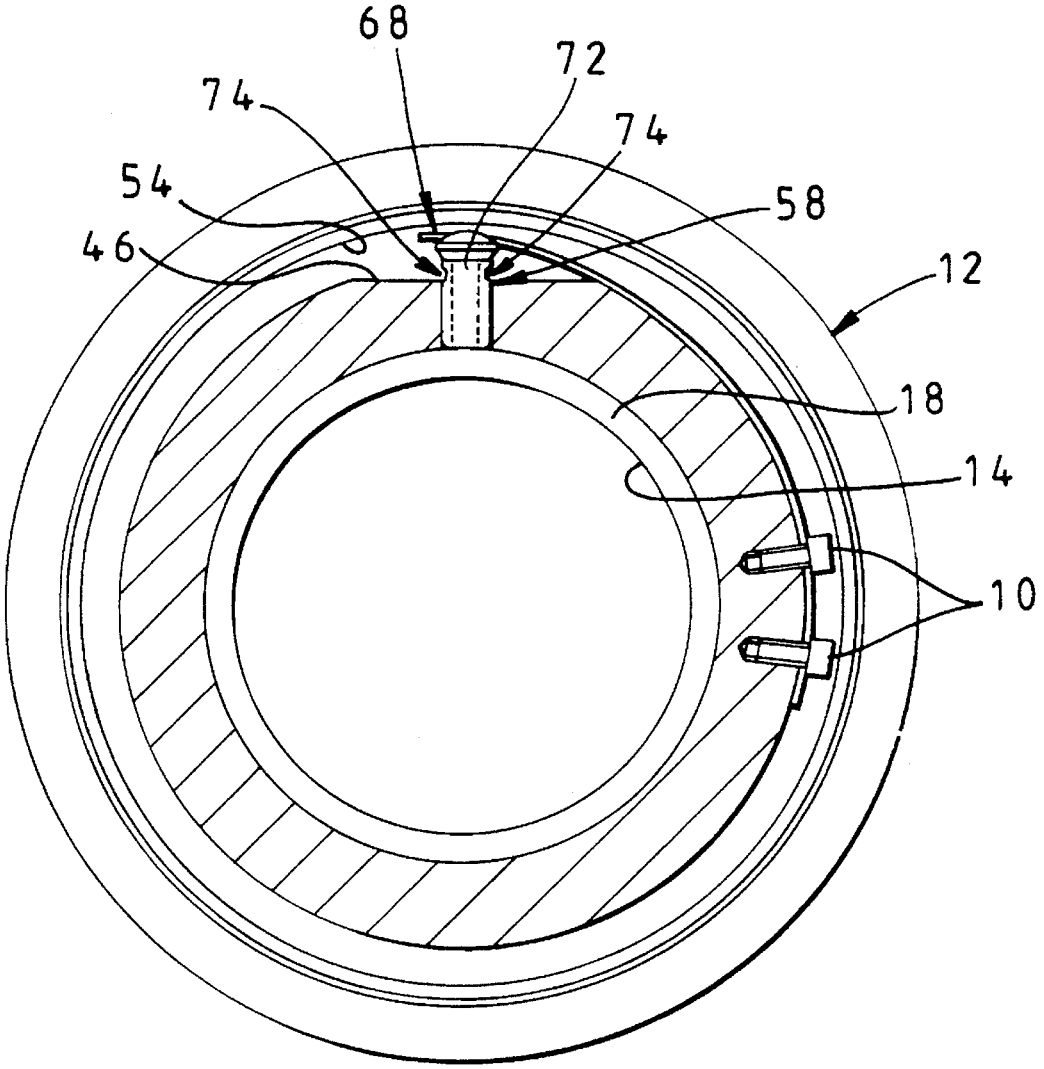
FIG. 5 is a sectional view taken along Line A—A of FIG. 4.

As shown in FIG. 5, the valve member 58 is held in a normally closed position by action of a circumferential spring 68 which is fastened to the annular housing 30 by way of screws 70. In the event that the spring 68 becomes damaged or fails, the valve member 58 cannot become lost within the wellbore because the valve member 58 will be retained within the annular space 54 about the annular housing 30. Further, if the spring 68 fails, the valve member 58 is designed to be forced into a closed position by action of the fluid pressure against the relatively large surface area of the shoulder 60.

The valve member 58 includes a generally longitudinal opening 72 which extends from the beveled portion 62 and is in communication with one or more generally tangential openings 74 that exit the valve member 58 at a location between the second end thereof and the sealing surface 64. The purpose of these openings 72 and 74 will be described below.

Figure 2:
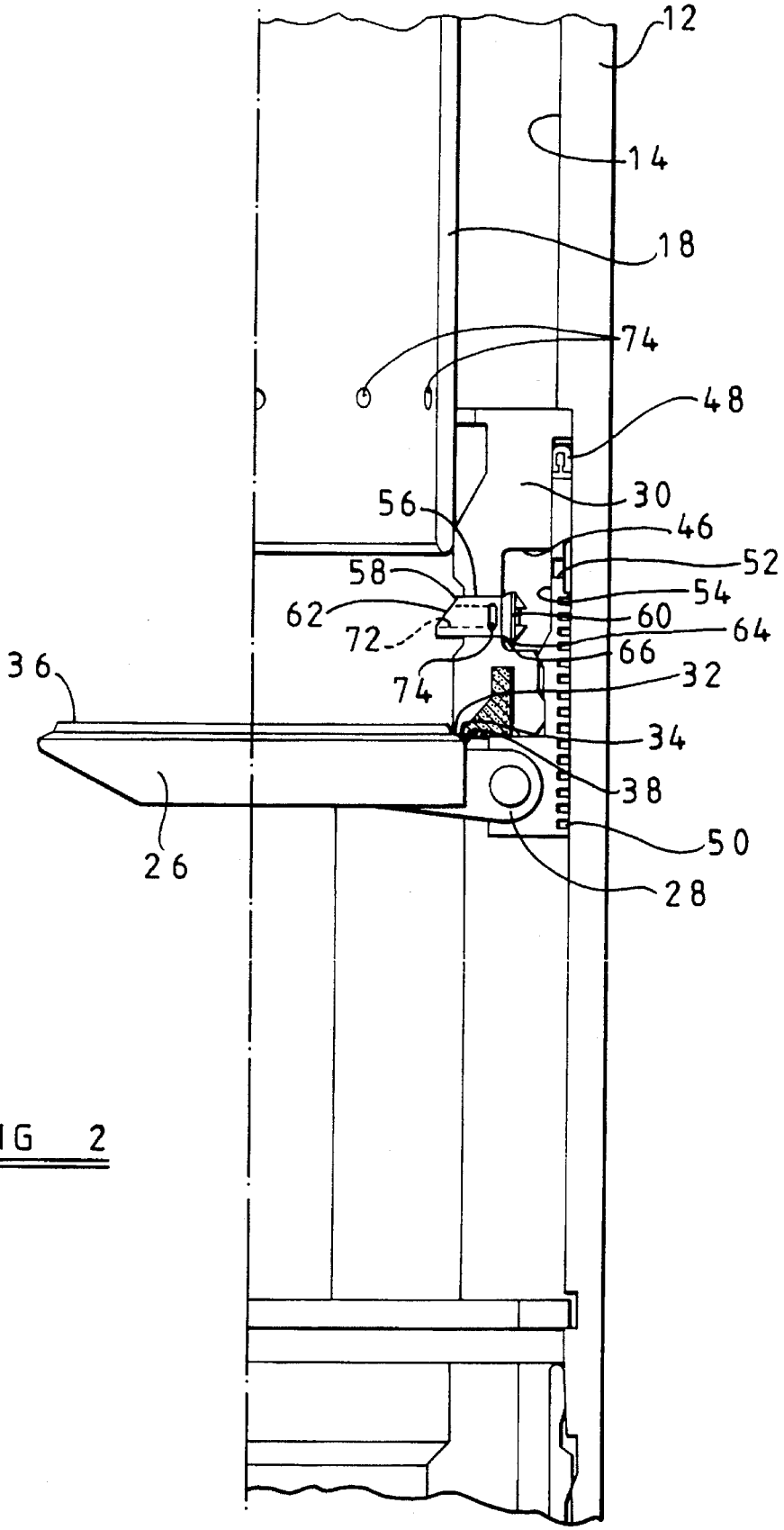
FIG. 2 is a fragmentary elevational view showing an equalizing mechanism of the present invention installed within a subsurface safety valve of FIG. 1 and shown in the closed position.
Figure 3:
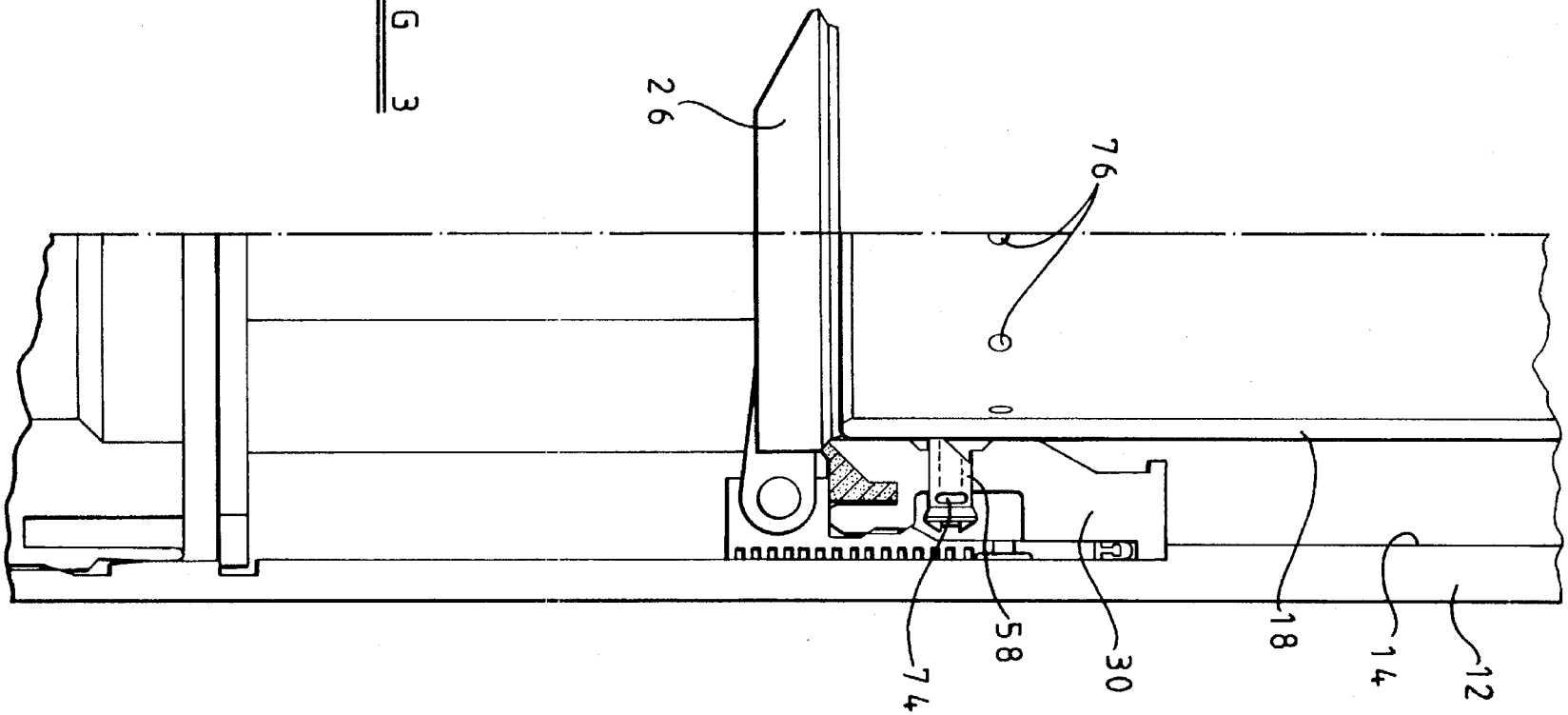
FIG. 3 is a view similar to FIG. 2 with the equalizing mechanism of the present invention shown in the equalizing position.

As shown in FIG. 2, the flapper 26 and the valve member 58 are in the closed position to prevent any fluid flow therepast. When the flapper 26 is to be opened, the flow tube 18 is forced towards the flapper 26 by the application of hydraulic fluid through the control conduit 44 (as has been described previously) or by electrical/mechanical action or simply mechanical action, depending upon the type of safety valve within which the present invention is included. As shown in FIG. 3, the second end of the valve member with the beveled end 62 extends into the bore 14. A lower portion of the flow tube 18 comes into contact with such beveled end 62 and causes same to be moved radially outward. The lower portion of the flow tube 18 is formed from material sufficiently hard to not be deformed or galled by contract with the beveled end 62, or a lower portion of the flow tube 18 can include a surface hard coating or be formed as a separate piece joined thereto and formed from harder material than the other portions of the flow tube 18.

When the valve member 58 is moved radially by contact with the flow tube 18, the annular sealing surfaces 64 and 66 are parted, then the valve member 58 is further moved radially to expose the one or more tangential openings 74. The relatively high pressure wellbore fluid then rapidly flows thereinto and out from the longitudinal opening 72 and into the bore 18 above the flapper 26. Since the tangential openings 74 are displaced from the annular sealing surfaces 64 and 66, the relatively rapid flow of wellbore fluids will not damage same. Additionally, the lower portion of the flow tube 18 includes one or more radial openings 76 to assist in the flow of wellbore fluids into the bore 14 by way of the interior longitudinal bore of the flow tube 18. Otherwise, the gap between the interior surface of the annular housing 30 and an exterior surface of the flow tube 18 may not be sufficiently large enough to permit the rapid equalization needed for efficient operation of the safety valve 10.

Figure 4:
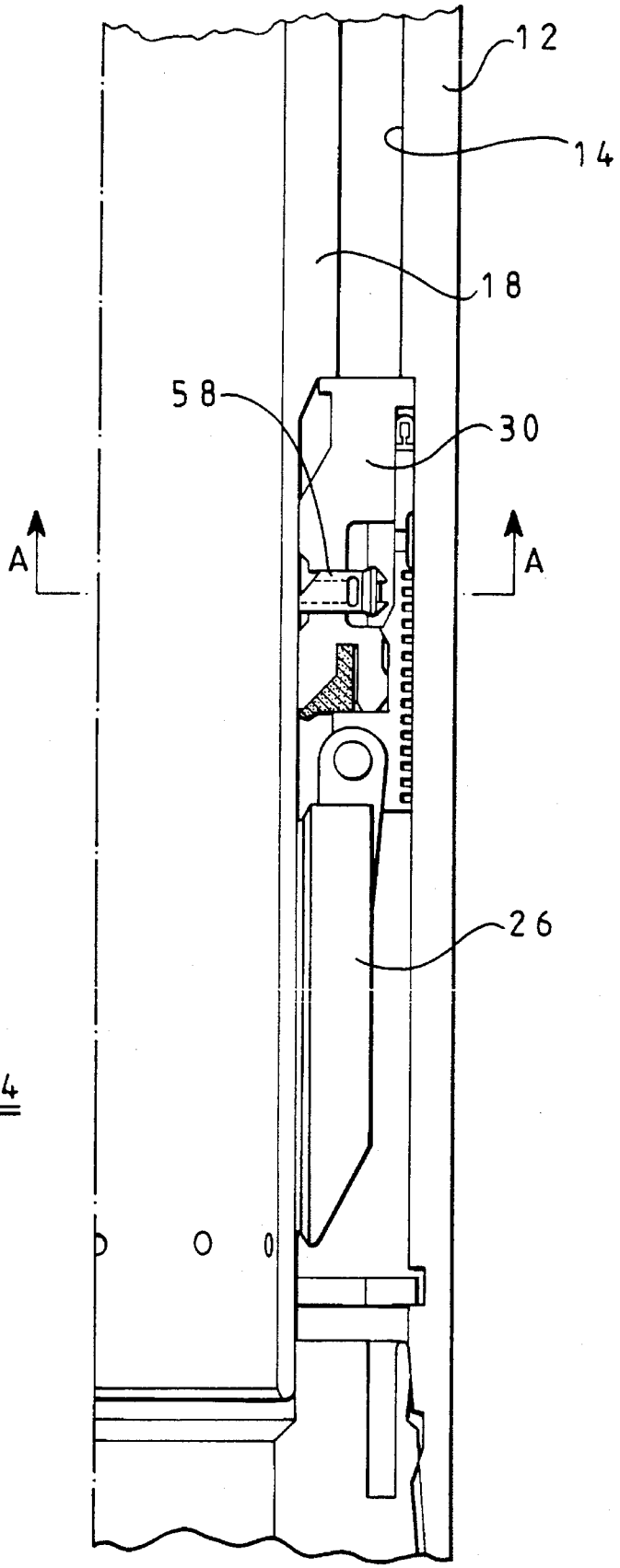
FIG. 4 is a view similar to FIG. 2 with the equalizing mechanism of the present invention shown in the open position.

The operator at the earth's surface can stop the movement of the flow tube 18 until the pressure equalization has occurred and then proceed with the opening of the flapper 26 (ie. a two-step process), or the flow tube 18 can be moved in a single continuous movement to open the flapper 26. In either case, the flow tube 18 is forced against the flapper 26 with sufficient force to overcome the hinge spring (not shown) and holds the flapper 26 in the open position, as shown in FIG. 4, as long as the hydraulic pressure from the control conduit 44 is applied. When the hydraulic pressure from the control conduit 44 is reduced or removed, the spring 20 causes the flow tube 18 to be moved away from the flapper 26, so that: (a) the flapper 26 rotates to a closed position and the sealing surfaces 34, 36 and 38 come into operative contact with each other to prevent fluid flow therepast, and (b) the flow tube 18 moves away from the beveled end 62 of the valve member 58 and the tangential opening 74 is moved into recess within the annular housing 30 and the sealing surfaces 64 and 66 come into operative contact with each other to prevent fluid flow therepast.

As has been described in detail above, the present invention has been contemplated to overcome the deficiencies of the prior equalizing safety valves specifically by preventing its equalization mechanism from being lost downhole and from being damaged by an initial flow of fluid when the flapper is opened.

Whereas the present invention has been described in relation to the drawings attached hereto, it should be understood that other and further modifications, apart from those shown or suggested herein, may be made within the scope and spirit of the present invention.

What is claimed is:

1. An equalizing subsurface safety valve for controlling fluid flow in a well conduit, comprising:

a tubular body member having a longitudinal bore extending therethrough;

a flapper hingably connected within the tubular body member to alternately permit and prevent fluid flow through the longitudinal bore;

means for biasing the flapper to a normally closed position to prevent fluid flow through the longitudinal bore;

means for controllably opening the flapper;

fluid passage for providing fluid communication between the longitudinal bore adjacent a first side of the flapper when the flapper is in a closed position and a second side of the closed flapper; and equalizing valve means for alternately permitting and preventing fluid flow through the fluid passage comprising:

a valve closure member mounted across the fluid passage adjacent the first side of the flapper and movable along an axis generally transverse to the longitudinal bore, spring means contained within the fluid passage for biasing the valve closure member against a sealing surface formed within the tubular body, and passage means within the valve closure member to prevent an initial fluid flow through the fluid passage from contacting the sealing surface.

2. An equalizing subsurface safety valve of claim 1 wherein the means for controllably opening the flapper further comprises a tubular member longitudinally movable within the longitudinal bore, and a piston and cylinder assembly mounted to the tubular body member with one side of the assembly adapted to be in communication with a source of hydraulic fluid for moving the flapper to the open position to permit fluid flow through the longitudinal bore.

3. An equalizing subsurface safety valve of claim 1 wherein the fluid passage further comprises an annular housing mounted to the tubular body member within the longitudinal bore and including an opening therewithin in communication with a recess adjacent an exterior portion thereof, and the valve closure member extending partially into the opening with the spring means contained in the recess.

4. An equalizing subsurface safety valve of claim 3 wherein the sealing surface further comprises an annular sealing surface formed in the annular housing around the opening therewithin.

5. An equalizing subsurface safety valve of claim 1 wherein the valve closure member further comprises a generally cylindrical plug having an enlarged annular sealing surface adjacent a first end thereof for cooperable sealing engagement with the sealing surface formed within the tubular body.

6. An equalizing subsurface safety valve of claim 5 wherein the generally cylindrical plug includes a second end opposite from the first end thereof and adapted to extend partially into the longitudinal bore when the plug is in a closed position.

7. An equalizing subsurface safety valve of claim 6 wherein the passage means further comprises an internal passageway within the generally cylindrical plug extending from the second end thereof to a location thereon spaced between the first end and the second end thereof and spaced from the enlarged sealing surface.

8. An equalizing subsurface safety valve of claim 5 wherein the generally cylindrical plug being moved from a normally closed position to an open position upon operable contact with the means for controllably opening the flapper.

9. An equalizing subsurface safety valve of claim 8 wherein the means for controlling the flapper further comprises a tubular member longitudinally movable within the longitudinal bore, and a piston and cylinder assembly mounted to the tubular body member with one side of the assembly adapted to be in communication with a source of hydraulic fluid for moving the flapper to the open position to permit fluid flow through the longitudinal bore.

10. An equalizing subsurface safety valve of claim 8 wherein the second end of the generally cylindrical plug being beveled to assist in its displacement upon operable contact with the means for controllably opening the flapper.

11. An equalizing subsurface safety valve for controlling fluid flow in a well conduit, comprising:

a tubular body member having a longitudinal bore extending therethrough;

a flapper hingably connected within the tubular body member to alternately permit and prevent fluid flow through the longitudinal bore;

means for biasing the flapper to a normally closed position to prevent fluid flow through the longitudinal bore;

means for controllably opening the flapper;

fluid passage formed within the tubular body for providing fluid communication between the longitudinal bore adjacent a first side of the flapper and a second side of the flapper;

closure member movably abutting a sealing surface formed within the tubular body adjacent the first side of the flapper for alternately permitting and preventing fluid flow through the fluid passage; and passage means formed on the closure member to prevent an initial fluid flow through the fluid passage from contacting the sealing surface.

* * * * *